US007422385B2

(12) United States Patent
Koeda et al.

(10) Patent No.: US 7,422,385 B2
(45) Date of Patent: Sep. 9, 2008

(54) PRINTING PAPER WINDING DEVICE

(75) Inventors: Akihiro Koeda, Tokyo (JP); Masahiro Kojima, Tokyo (JP); Tadanobu Uchidate, Tokyo (JP); Sakae Takeuchi, Tokyo (JP); Tsutomu Tabata, Tokyo (JP); Kazuya Suzuki, Tokyo (JP)

(73) Assignee: Kabushiki Kaisha Sato (JP)

( * ) Notice: Subject to any disclaimer, the term of this patent is extended or adjusted under 35 U.S.C. 154(b) by 59 days.

(21) Appl. No.: 11/507,738

(22) Filed: Aug. 22, 2006

(65) Prior Publication Data

US 2007/0079713 A1 Apr. 12, 2007

Related U.S. Application Data

(63) Continuation of application No. PCT/JP2005/021719, filed on Nov. 25, 2005, and a continuation of application No. PCT/JP2005/023784, filed on Dec. 26, 2005.

(51) Int. Cl.
*B41J 11/00* (2006.01)
*B41J 15/00* (2006.01)
*B41F 13/54* (2006.01)

(52) U.S. Cl. ..... 400/618; 101/228

(58) Field of Classification Search ..... 400/618–620, 400/611; 101/228; 242/417, 532.1, 532.6
See application file for complete search history.

(56) References Cited

U.S. PATENT DOCUMENTS 5,195,691 A * 3/1993 Pfeiffer et al. ..... 242/417
5,402,961 A * 4/1995 Kita ..... 242/532.1
5,448,431 A * 9/1995 Kobayashi ..... 360/85

FOREIGN PATENT DOCUMENTS

JP 2004-314565 * 11/2004

* cited by examiner

*Primary Examiner*—Judy Nguyen
*Assistant Examiner*—M. L. Ferguson-Samreth
(74) *Attorney, Agent, or Firm*—Ostrolenk, Faber, Gerb & Soffen LLP

(57) ABSTRACT

A printing paper winding device for enabling winding of printing paper even paper with a base material having a low resistance to bending stresses or printing paper having RFID labels carrying IC chips. Bending stresses are reduced by dividing the movement region of the tension roller into four regions in order to enable the successive detection of the position or posture of the tension roller and by making the bending angle of the printing paper in the winding path close to a more obtuse angle. A winding control unit of the present invention determines whether the tension region where the tension roller is positioned is a first tension region, second tension region, third tension region, or fourth tension region, controls the drive unit to limit the tension roller to a tension region in which winding is possible in the direction such that the bending angle of the printing paper in the winding path, which follows the winding of the printing paper, is close to a more obtuse angle.

15 Claims, 11 Drawing Sheets

| | First Sensor | Second Sensor |
|---|---|---|
| First tension region | L | L |
| Second tension region | H | L |
| Third tension region | H | H |
| Fourth tension region | L | H |

FIG. 4

PRINTING PAPER WINDING DEVICE

CROSS REFERENCE TO RELATED APPLICATIONS

The present invention is a continuation of International Application No. PCT/JP2005/021719, filed Nov. 25, 2005 and International Application No. PCT/JP2005/023784, filed Dec. 26, 2005, which claim priority to Japanese Patent Application No. 2004-347631, filed Nov. 30, 2004 and Japanese Patent Application No. 2004-377632, Dec. 27, 2004, respectively.

BACKGROUND OF THE INVENTION

1. Field of the Invention

The present invention relates to a printing paper winding device, and more particularly to a printing paper winding device that is independent of a printer that prints on printing paper that is wound by the winding device. More particularly, the invention relates to apparatus for controlling tension on the web of paper being wound. The apparatus includes a tension roll that applies a controllable tension during winding of the continuous web.

Further, the winding device is useful for continuously winding a continuous web of paper carrying a strip of labels evenly spaced apart on a continuous base comprised of the paper web. Each such label may be an RFID label, having a middle-layer which includes an RFID circuit, which is encapsulated. More particularly, the apparatus for winding the continuous web affects flexure stress.

2. Description of the Prior Art

Some conventional printing paper winding devices are configured as external devices separate from a printer. Such devices are installed in front of the paper discharge opening of a printer and successively wind up a continuous band or web of paper or printing paper. That band includes a base paper layer carrying printed labels and from which the printed labels are to be peeled off. The paper or labels thereon are printed by the printer and then discharged from the printer. After the labels are printed, the base layer with the labels thereon is wound on a spindle. The spindle is later placed in a label applying apparatus, where the labels are separated from the continuous base and applied to items to be labeled.

Such a printing paper winding device comprises a winding shaft for winding up the continuous, band-like printing paper on which printing has been performed by a printer, a drive unit (for example, a drive motor) for rotary driving of the winding shaft, and a tension roller at the winding device that comes into contact with the printing paper upstream in the path of the printing paper from the winding shaft.

The tension roller reciprocates on the winding device through a predetermined tension region of the paper, while maintaining contact with the printing paper, as the printing paper is printed upon, discharged from the printing device, and wound up on the winding shaft or on a reel or a take up spindle on the winding shaft. The tension roller can apply tension to the printing paper so as to absorb the slack of the printing paper, and can thereby stabilize the winding force on the winding shaft. By reciprocally moving through the tension region, the tension roller can eliminate the flexure of the continuous paper web by providing tension to the continuous web, enabling a winding effort to be maintained on the winding shaft or the take up spindle. The tension roll is provided on the winding apparatus. The tension roll reciprocation range is usually predetermined, such that the tension roll can be moved between an upper and a lower portion of the range, so that the continuous web can be reeled up while the tension roll provides a selectable tension to the continuous web.

In such a printing paper winding device, the leading end of the band-like printing paper discharged from a printer is usually fixed to the winding shaft, the tension roller is set to a state where it can contact the printing paper, and then the drive unit is started to begin winding the printing paper.

However, because the tension roller reciprocates along a predetermined reciprocating path as the printing paper is being wound up, the driver unit has to be ON/OFF controlled, the winding speed is constant, and the winding path of the printing paper follows a zigzag shape. The resulting problem is that bending stresses or bending pressure accompanies the winding operation.

This may limit the base material of the printing paper to one that can withstand the winding tension caused by a large bending stress applied in the zone of the reciprocation path where the winding path of the paper bends at an acute angle. This has caused problems in that the printing paper may rupture or the labels attached to the base paper may prematurely peel off, instead of the printing paper with the intact labels thereon being wound onto the winding spindle.

Furthermore, when the printing paper support labels (RFID labels) that have IC chips placed thereon in which data can be read and written remotely, if the winding path of the printing paper is bent at a very acute angle, disconnection of the RFID label from the continuous paper or fracture of the IC chip can occur, when the tension roller is shifted along a movement or reciprocation range. There, the continuous web may be bent at a considerable angle by the so located tension roller.

The considerable angle applies bending stress to the continuous web. If the continuous web has an RFID inlay, the RFID inlay may include a single IC chip and an antenna, which is included in a label or tag on the continuous base. Such a RFID tag or label has a disadvantage in that the antenna may be bent or its junction connecting the IC chip to the antenna part may be broken in the bending of the web or of the paper web at a sharp or acute angle.

Furthermore, an adhesive agent applies the label on the continuous base paper layer at even intervals. When it is a usual, soft adhesive agent, the labels separate from the continuous web when there is a considerable angle on the continuous label web, particularly a bend caused by the tension roller.

Furthermore, the above-described type of printing paper winding device is often controlled integrally or together with the printer for the labels by a printer control unit. Then driving the winding device requires using special printers. Therefore, such a winding device does not function to appropriately wind up the printing paper printed by and discharged from any printer, and the device lacks versatility for forming combinations with printers.

SUMMARY OF THE INVENTION

The present invention has an object to resolve the above-described problems. It is an object thereof to provide a printing paper winding device that can wind up any printing paper, including such paper comprising a base material with a low resistance to bending stresses.

It is another object of the present invention to provide a printing paper winding device that can wind up printing paper that carries labels and individual RFID labels which carry IC chips.

Yet another object of the present invention is to provide a printing paper winding device that can wind up printing paper, including paper with poor resistance to winding or bending stresses.

It is yet another object of the present invention to provide a printing paper winding device that can substantially expand the range of base material types of printing paper that is suitable for winding.

Another object is to provide a winding apparatus for winding a continuous web which receives bending stress, especially such a continuous web having a plurality of RFID tags or labels, each having an IC-chip and antenna part attached on an RFID inlay.

Furthermore, another object is to provide a winding apparatus which prevents the label strip from breaking off the continuous web by using a soft adhesive agent to retain the label strip applied on the continuous base.

One more object of the present invention is to provide a printing paper winding device that can be independently controlled, even when it is arranged independently from a printer, and that can appropriately wind up printing paper on which printing has been performed and which has been discharged from any printer.

The present invention provides a winding apparatus for properly winding the continuous web 2 that receives bending stress, by causing the tension roll to be optionally moved over a movement range to enable limiting the bend angle on a winding path of the continuous web 2.

A primary aspect of the present invention is to reduce bending stresses on the web by dividing the reciprocating movement region of the tension roller into four tension regions. This enables successive detections of the position or posture of the tension roller and enables making the bending angle of the printing paper in the winding path a more obtuse angle than might otherwise be present.

The invention concerns a printing paper winding device comprising a winding shaft for winding up band-like printing paper which has been printed by a printer, a drive unit for rotationally driving the winding shaft, and a tension roller on the winding device that contacts the printing paper upstream of the winding shaft in the path of the paper and which can apply tension to the printing paper by the tension roller reciprocating through a prescribed tension region during the winding of the printing paper.

The printing paper winding device further comprises a first sensor and a second sensor, each operable for detecting the portion of the entire tension region in which the tension roller is then positioned and a winding control unit, operable based on the output signals of the first sensor and second sensor, for determining whether the tension region in which the tension roller is then positioned is a first tension region in which the bending angle of the winding path of the printing paper becomes minimized and more acute, a second tension region, a third tension region, or a fourth tension region in which the bending angle of the winding path of the printing paper becomes maximized and more obtuse. Those tension regions are arranged continuously, successively and adjacent to each other. The winding control unit controls the drive unit so as to limit the tension roller to the tension region in which winding can be conducted in a direction such that the bending angle of the winding path that follows the winding of the printing paper is closer to a more obtuse angle.

The winding control unit can control the tension region where the tension roller is positioned so that the tension region becomes closer to the fourth tension region. The winding apparatus optionally may include a restricting member for controlling or restricting the optional movement of the tension roll to for example, limit or control of the bend angle of the continuous web on the winding path.

A dip switch may be operable to select the tension region where the tension roller is positioned. The winding control unit can control the tension region where the tension roller is positioned according to conditions that are set with the dip switch.

A first fixed guide roller positioned upstream of the tension roller is operable for guiding and introducing the printing paper from the printer into the printing paper winding device. A second fixed guide roller is operable for guiding the printing paper from the tension roller onto the winding shaft. The control can be operated so that the bending angle of the winding path of the printing paper formed by the printer, the first fixed guide roller, and the tension roller is made closer to a more obtuse angle. The bending angle of the winding path of the printing paper formed by the first fixed guide roller, the tension roller, and the second fixed guide roller is made closer to a more obtuse angle. The bending angle of the winding path of the printing paper formed by the tension roller, the second fixed guide roller, and the winding shaft is made closer to a more obtuse angle.

The printing paper may have labels thereon, and each label may include an IC chip on which data can be read and written remotely.

There may be a roller arm for holding the tension roller. A roller rotary shaft rotatably supports the tension arm or roller arm and the roller arm is swingable around an axis to swing the tension roller reciprocally in the forward and backward, or down and up, directions across the winding path to affect web tension.

A sensor plate that is operable to rotate about the roller rotary shaft has formed therein alternate detection protrusions and detection recesses that can be detected by the first sensor and the second sensor.

The winding apparatus includes an arcuate motion guide or channel, e.g., in the form of a slit, provided on a lateral surface on a housing of the winding apparatus and preferably located at the radial position of the tension roller along the tension shaft capable of following and also of controlling arcuate reciprocating movement of the tension roll.

The tension roll is provided on one end of the tension arm away from the swing axis of the arm so that the roll is swingable around the tension arm axis and is guided in the motion guide or arcuate slit extending vertically on the lateral surface of the housing.

In a further embodiment, a restricting member is operable for restricting motion of the tension roller and for stopping it at or holding it in an optimal position within the arcuate slit. The restricting member may be made of a hard, but elastic material. The restricting member is located in the motion guide, such as in the arcuate slit and is engageable there by the tension roller. The restricting member enable easy movement, but allows optionally restricted movement of the tension roller so that it is not swingable through a large angle across the winding path direction of the continuous web. This enables a winding apparatus, which winds a continuous web that is vulnerable to a bending stress or is formed using a soft adhesive agent to apply the label strip on the continuous base to not apply a damaging bending stress.

A detecting member is operable for detecting the lowest swing motion position of the tension roller in its movement range.

The winding control unit is operable to control the printing paper winding device independently from the printer control unit for the printer which prints on the printing paper.

After the tension roller has been positioned in the fourth tension region (most obtuse bend angle) and initial setting for winding has been carried out, the tension roller is moved across the winding direction in the direction toward the first tension region while the printing paper is being printed upon and then discharged from the printer. At the time when the winding path is extended to a maximum length (that is, when the bending angle of the winding path becomes minimized or most acute), the winding operation is started. This returns the tension roller back toward the first tension region. When the tension roller reaches the fourth tension region and the winding path becomes maximized (that is, when the bending angle of the winding path becomes maximized or most obtuse), the winding operation is stopped and the system waits for the printing and discharge of the printing paper from the printer. Then, the above-described operations are repeated.

When the printing paper has a usual bending strength, the control is preferably operated to reciprocate the tension roller in the tension regions other than the first and fourth tension regions, that is, in the intermediate second tension region and third tension regions, in order to provide a margin for the reciprocating movement of the tension roller.

However, when printing paper with low bending strength or printing paper carrying RFID labels is used, the control is preferably operated so as to reciprocate the tension roller as close to the fourth tension region as possible.

As was noted above, the printing paper winding device has a movement region of the tension roller that is divided into four tension regions. When printing paper with a small resistance to bending stresses is being wound, the drive unit is controlled so that the bending angle of the winding path through which the tension roller passes is maximized closer to a more obtuse angle. This prevents the bending angle of the printing paper from becoming more acute. The bending stresses can be reduced, the range of printing paper types suitable for winding can be expanded, and even printing paper with RFID labels removably attached thereto can be correctly wound, while avoiding rupture of the RFID labels or the RFID tags in the labels.

In a preferred arrangement, the tension roller is supported on a swingable roller arm that pivots around a swing axis. The tension roller swings through an arcuate pathway. A housing or wall supporting the tension roller arm and its axis has an arcuate slit or other arcuate guide positioned for guiding the swing path of the tension roller. The length of slit or guide determines the ends of the swing path in the first and fourth tension regions.

In a modified embodiment, the arcuate guide or slit optionally has a motion restriction in the swing path of the tension roller in the arcuate guide or slit which restricts the full extent of swinging. In particular, the restriction prevents the tension roller moving the full possible distance into the first tension region, that is, it increases the minimum acute bend angle of the paper strip and thereby reduces the sharpness of the bend of the printing paper. This in turn reduces the maximum stresses on the paper strip and on the labels and RFID labels, if any, on the strip. A detector detects the position of the restriction and thereby detects the lowest part of the swing path of the tension roller, and therefore the smallest acute angle at which the paper strip will be bent.

Other objects and features of the invention will be described below with reference to the accompanying drawings.

BRIEF DESCRIPTION OF THE DRAWINGS

FIG. 4 is a table showing tension regions where the tension roller is positioned, those regions being distinguished by the detection signals of a first and second sensor;

DESCRIPTION OF PREFERRED EMBODIMENTS

In accordance with the present invention, a drive unit is controlled so as to limit the position of a tension roller to a tension region in which winding of a printing paper web can be conducted in the direction such that the bending angle of the winding path that bends to the winding of the printing paper defines a more obtuse angle and thus the web bends at a less acute angle. This enables operation of a printing paper winding device that is suitable for winding even printing paper with a low resistance to bending stresses.

The printing paper winding device 2 of an embodiment of the present invention is explained below with reference to FIG. 1 to FIG. 8.

Figure 1:
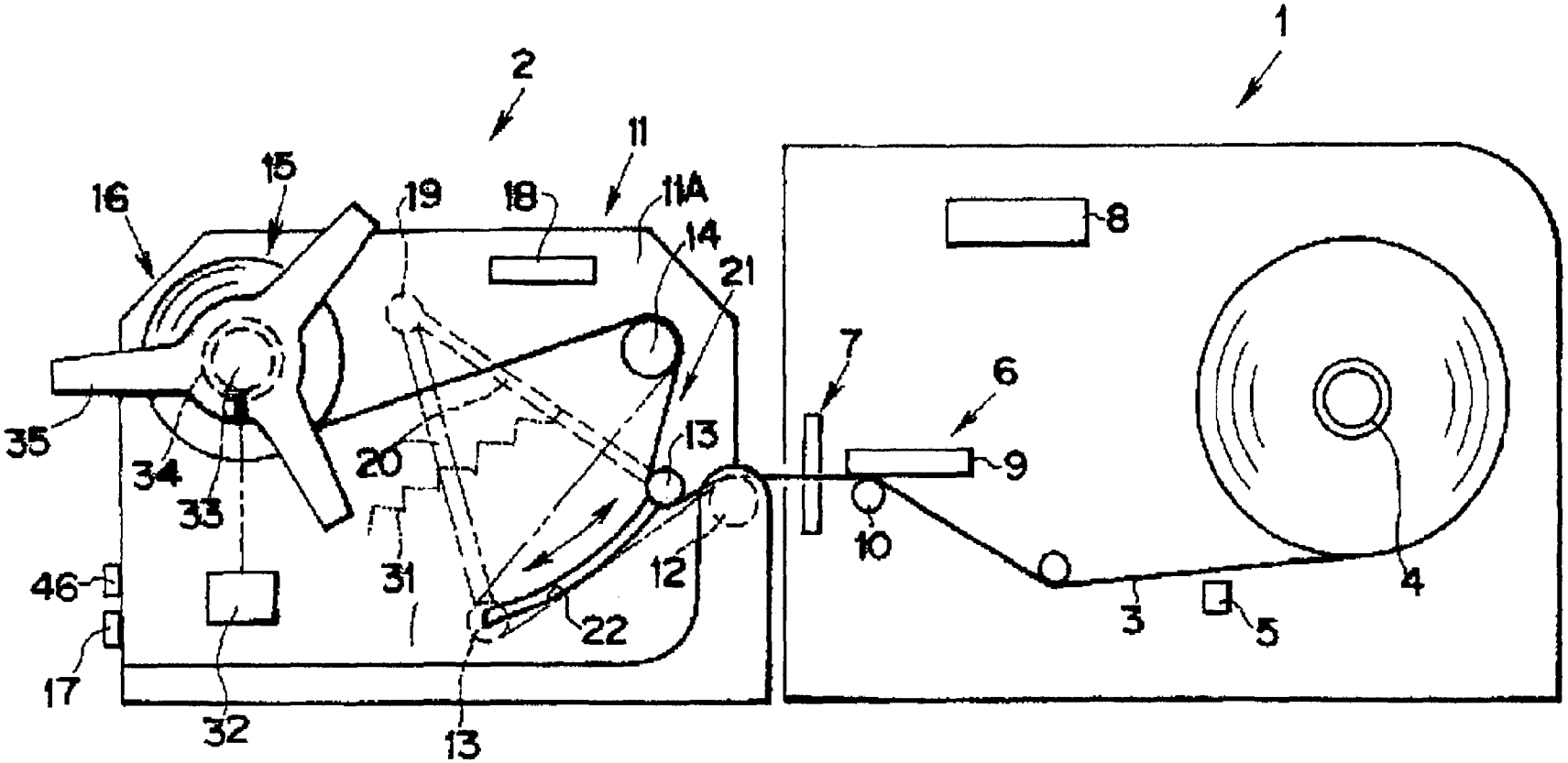
FIG. 1 is a schematic side view of a printing paper winding device of an embodiment of the present invention and showing a printer connected to a printing paper winding device.

FIG. 1 is a schematic side view of a printer 1 and of a printing paper winding device 2 connected to the printer 1. The printer 1 has a supply unit 4 for printing paper 3. That paper is provided thereon, for example, with labels or tags. A detector 5 detects the position of the printing paper 3, and particularly the labels on tags thereon. A printing unit 6 prints on the printing paper 3. A cutting unit 7 cuts the trailing end section of the printed printing paper 3 after it has been wound up by the printing paper winding device 2, and a printer control unit 8 controls the aforementioned units.

The printing unit has a thermal head 9 and a platen roller 10. The printing paper 3 is sandwiched between the thermal head 9 and the platen roller 10, and the printing paper 3 is discharged and transported toward the printing paper winding device 2 by rotation of the platen roller 10 after predetermined information has been printed on the printing paper 3.

The cutting unit 7 may be driven by the printer control unit 8 to mechanically cut the printing paper 3 or it can comprise a member for cutting the end section of the printing paper 3 manually.

Figure 2:
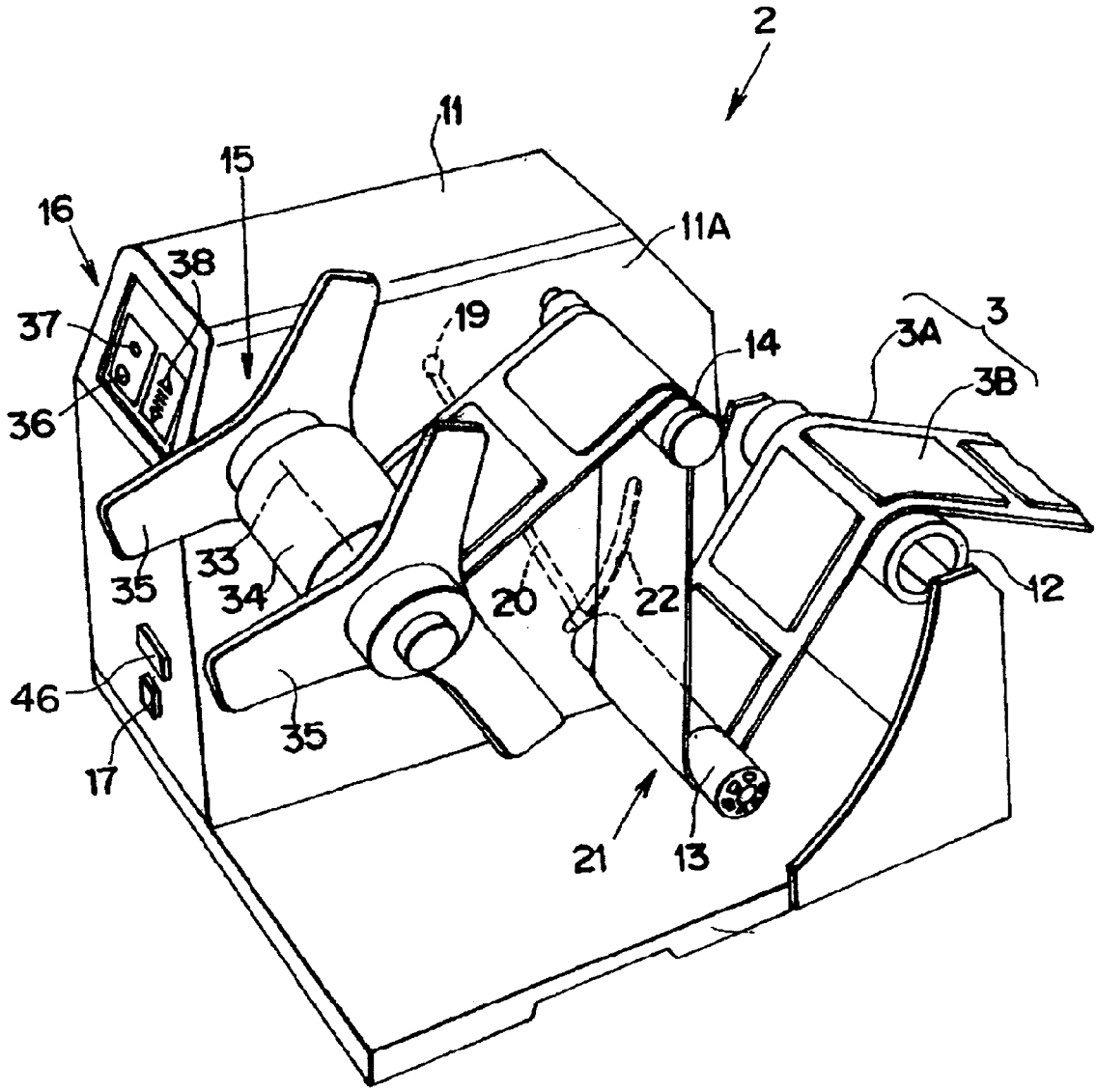
FIG. 2 is a perspective view of the printing paper winding device.

FIG. 2 is a perspective view of the printing paper winding device 2. The printing paper winding device 2 has a device body 11, a first fixed guide roller 12 for guiding and introducing the printed printing paper 3 into the printing paper winding device 2, a movable, and particularly a swingable, tension roller 13, a second fixed guide roller 14 for guiding the printing paper 3 from the tension roller 13, a winding unit 15 for winding the printing paper 3 into a roll, a control unit 16, a power source switch 17, and a winding control unit 18.

A tension roller rotary support shaft 19 is provided at a vertical wall surface section 11A in the device body 11. A roller arm 20, which can swing around the shaft 19 as an axis, can swing in both the forward or direct direction generally downstream in the web path and in the reverse direction, is mounted on the roller rotary shaft 19. The tension roller 13 is rotatably mounted on a distal end section of the swingable roller arm 20. The tension roller 13 is positioned so as to extend across the winding path 21 (for example, shown as a zigzag line in FIG. 1) of the printing paper 3 and moves at a right angle to the web.

The tension roller 13 can swing reciprocatingly up and down along a circular arc, as shown by arrows in FIG. 1, according to the winding state of the printing paper 3. The roller reciprocates along a guide in the form of a circular arc, guide groove 22 formed in the vertical wall surface section 11A of the housing. This swinging changes the length of the winding path 21 from minimum to maximum and, corresponding to this change, changes the bending angle(s) of the winding path 21 from maximum or more obtuse to minimum or more acute.

Figure 3:
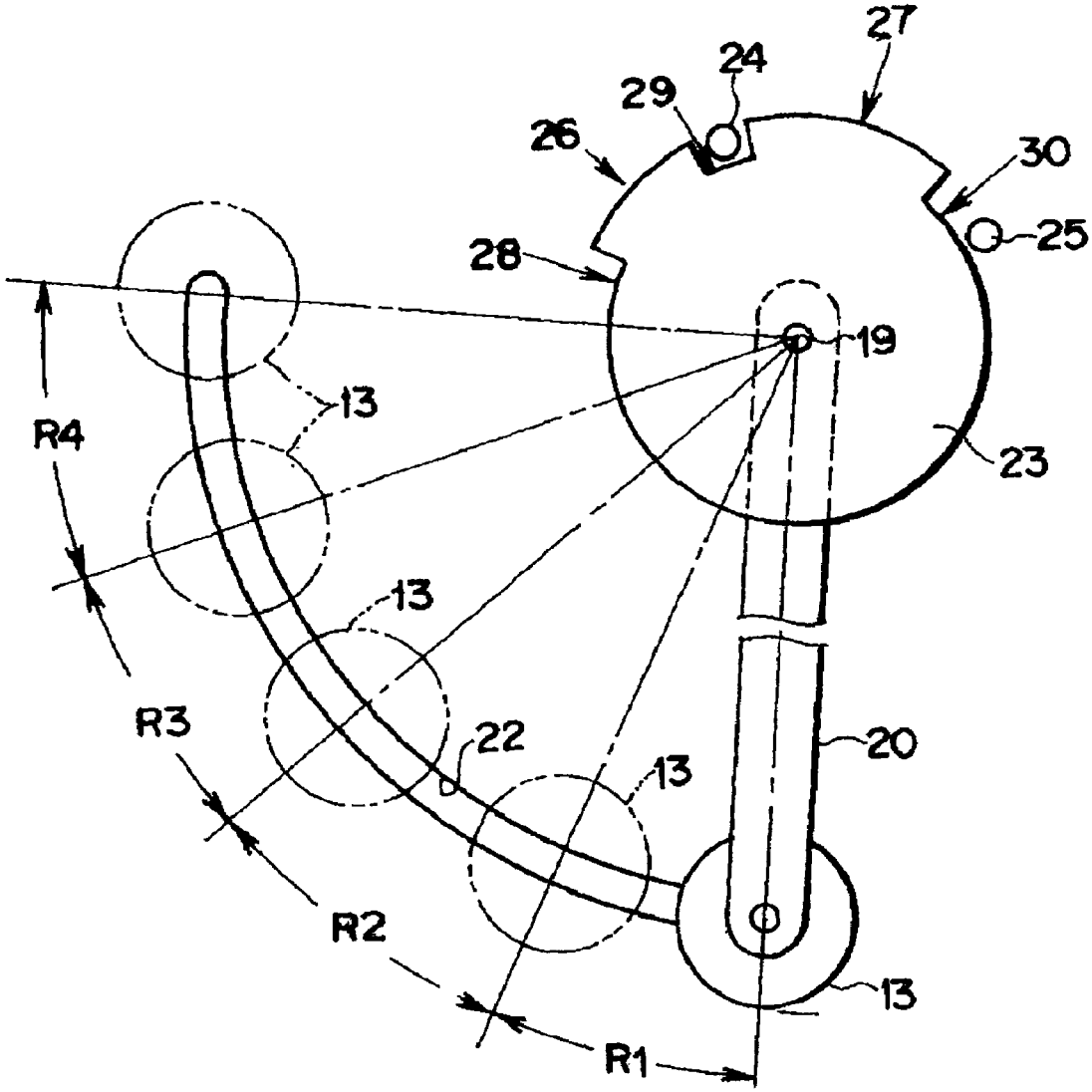
FIG. 3 a side view of a vertical wall surface section of the winding device taken from a surface on the opposite side from the surface where the tension roller is positioned.

FIG. 3 is a side view of the vertical wall surface section 11A taken from the surface on the opposite side from the surface where the tension roller 13 is positioned. The position of the tension roller 13 can be detected using a sensor plate 23, a first sensor 24, and a second sensor 25.

The sensor plate 23 is mounted on the roller rotary shaft 19 and rotates together with the tension roller 13 about the roller rotary shaft 19. Two detection protrusions (first detection protrusion 26 and second detection protrusion 27) and three detection recesses (first detection recess 28, second detection recess 29, and third detection recess 30) can be detected by the first sensor 24 and the second sensor 25. The protrusions and recesses alternate on the peripheral section of the sensor plate 23.

Transmission-type or reflection-type detectors can be employed for the first sensor 24 and the second sensor 25. They are arranged on the circumference in positions enabling the detection of the first detection protrusion 26, second detection protrusion 27, first detection recess 28, second detection recess 29, and third detection recess 30.

In the lowermost position (lower dead center, first tension region) of the tension roller 13 shown solid line in FIG. 3, the first sensor 24 is close to the second detection recess 29, and the second sensor 25 is close to the third detection recess 30.

The roller rotary shaft 19 is preferably arranged vertically above the tension roller 13. Depending on their mutual arrangement, a posture can be naturally assumed under gravity in which the tension roller 13 is positioned vertically below and inside the circular arc guide groove 22. In this way, the tension roller 13 can constantly apply a predetermined tension on the printing paper 3 that comes into contact with the roller from above, as shown in FIG. 1 and FIG. 2.

Furthermore, if deemed necessary, the tension roller 13 can be constantly impelled toward the lowermost section (lower dead center) inside the circular arc guide groove 22 by mounting a tension spring 31 (FIG. 1) on the roller arm 20.

Figure 5:
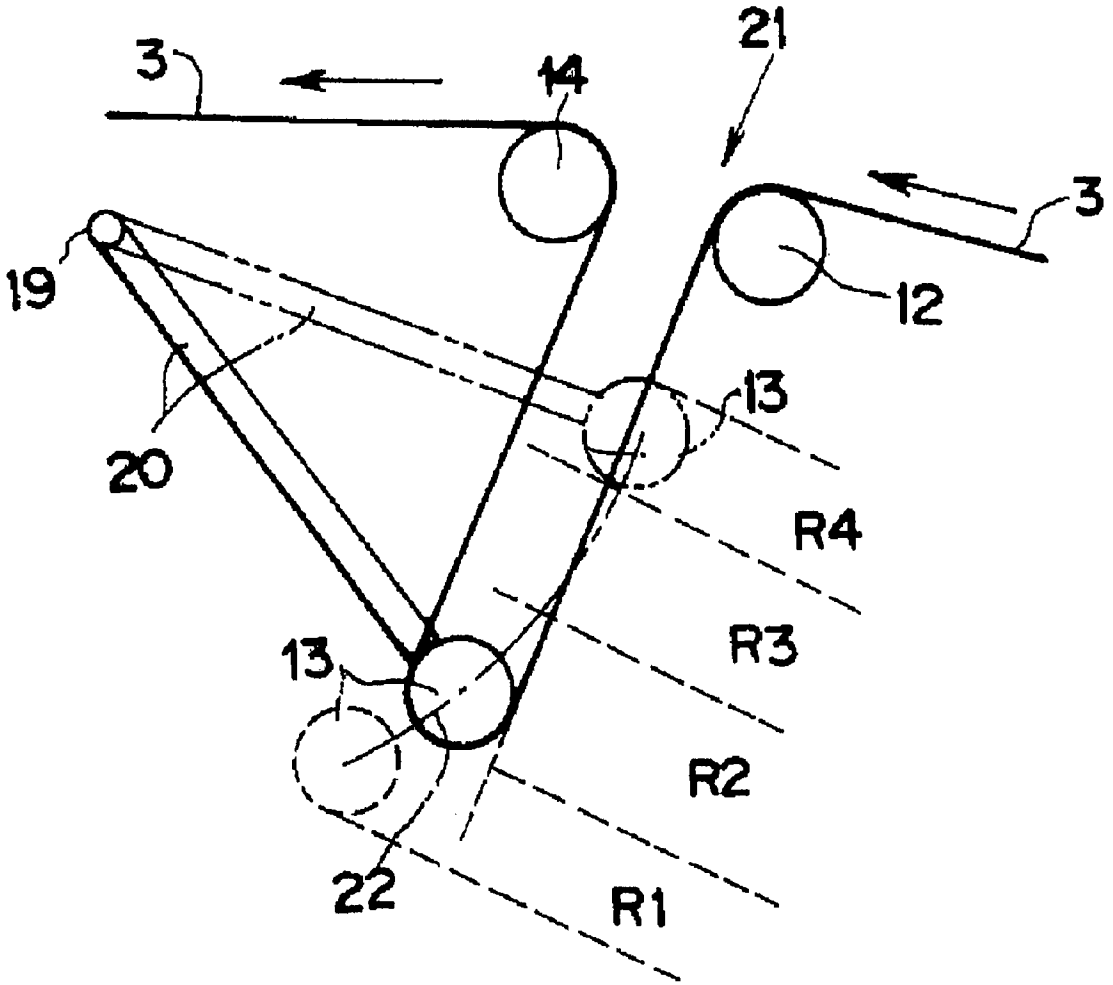
FIG. 5 is an explanatory drawing schematically describing each tension region of the device.

FIG. 4 is a table showing tension regions where the tension roller 13 is positioned. Those regions are distinguished by the detection signals of the first sensor 24 and the second sensor 25. FIG. 5 is an explanatory drawing schematically describing each tension region.

The solid line state in FIG. 3 illustrates the lower dead center 13, which is a lowermost point in the first tension region R1. In this state, the first sensor 24 detects the position of the second detection recess 29, and the second sensor 25 detects the position of the third detection recess 30.

As the tension roller 13 rises clockwise in FIG. 3 inside the circular arc guide groove 22, the first sensor 24 and the second sensor 25 detect the first detection protrusion 26, second detection protrusion 27, first detection recess 28, second detection recess 29, and third detection recess 30 and generate detection signals. Based on the detection signals, the winding control unit 18 determines the tension region (first tension region R1, second tension region R2, third tension region R3, and fourth tension region R4 arranged continuously and adjacently to each other) in which the tension roller 13 is then positioned.

The detection timing of the tension regions (boundary sections of the first tension region R1, second tension region R2, third tension region R3, and fourth tension region R4) of the tension roller 13 can be adjusted by appropriately selecting the circumferential angles of the first detection protrusion 26, second detection protrusion 27, first detection recess 28, second detection recess 29, and third detection recess 30 about the roller rotary shaft 19 of the sensor plate 23 and the relative positions of the first sensor 24 and second sensor 25.

Returning to FIG. 1 and FIG. 2, the winding unit 15 has a drive motor (drive unit) 32, a winding shaft 33, which is rotary driven by the drive motor 32, a winding core or spindle 34 that is removably fit onto the winding shaft 33, rotates integrally with the winding shaft 33, and winds the printing paper 3 thereon in the form of a roll. A pair of paper guides 35 provided at both ends of the rewind core 34 guide the printing paper 3.

The control unit 16 is provided in the portion of the device body 11 in the vicinity of the winding unit 15. The control unit has a start-stop button 36 for starting and stopping the rotation drive of the winding shaft 33, a status display unit 37 comprising a LED that indicates the operation status of the start-stop button 36, and a winding direction display unit 38 that indicates the winding direction of the printing paper 3 with an arrow.

When the start-stop button 36 is pushed to cause winding up the printing paper 3, the status display unit 37 is turned on. When the winding is stopped, the status display unit 37 is turned off.

The winding direction display unit 38 displays the indication of rear winding or face winding of the printing paper 3.

Figure 11:
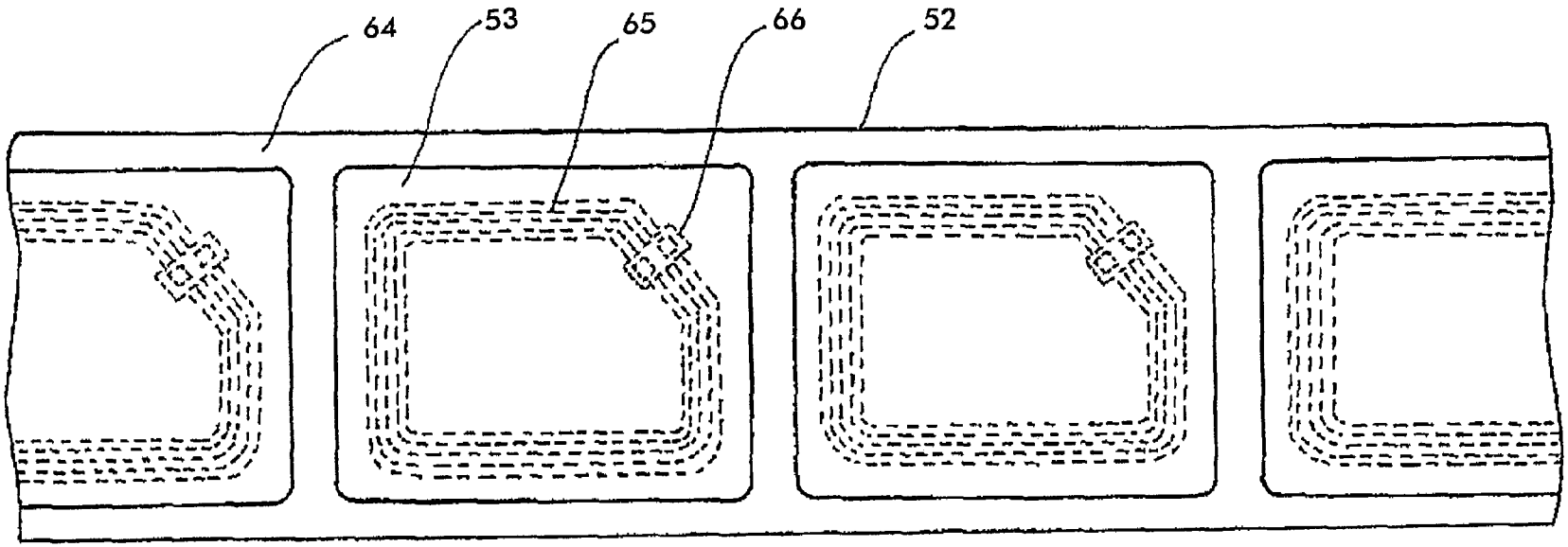
FIG. 11 illustrates a continuous printing paper web, with a plurality of labels including RFID tags, which is of the type subjected to bending stresses.

The printing paper 3 can be a continuous label or tag paper having no adhesive surface, or it can be a label continuous body in which a plurality of label pieces 3B are removably attached to a band-like base paper 3A, as shown as an example in FIG. 2, or it can be labels, as in FIG. 11 described below. In the case of such a label continuous body, a winding operation, in which the label pieces 3B are wound up on the inner side (rear side) of a roll on the winding shaft 33 (rewind core 34), is called rear winding and a winding operation, in which the label pieces are wound up on the outer side (face side), is called face winding.

The power source switch 17 serves to turn ON/OFF the power source of the printing paper winding device 2. However, even if the power source switch 17 is turned ON, the drive motor 32 (drive unit) is not actuated and the operation of winding the printing paper 3 is not yet started.

The winding control unit 18 drive controls the winding unit 15 and control unit 16 based on the detection signals of the first sensor 24 and the second sensor 25. Based on the tension region (R1, R2, R3, or R4) in which the tension roller 13 is then positioned, the control unit controls the printing paper winding device 2, regardless of the control signal from the printer control unit 8 (FIG. 1) of the printer 1, that is, independently from the printer control unit 8.

In the printing paper winding device 2 and printer 1 of such configuration, the printing paper winding device 2 is placed at the printer 1 according to the posture thereof. The printing paper 3 discharged and extending from the side of the printer 1 is wrapped around the first fixed guide roller 12, tension roller 13, and second fixed guide roller 14 of the printing paper winding device 2 in the state shown in FIG. 1 or FIG. 2. The leading end section of the printing paper 3 is attached and fixed to the winding core 34 of the winding shaft 33. Then the power source switch 17 is turned on.

When the entire printing paper 3 is in a loosened state and the tension roller 13 is in the lowermost point (lower dead center, first tension region R1), and the printing paper 3 is then set on the winding path 21, the winding control unit 18 checks that the tension roller 13 is in the first tension region R1 when the operation of wrapping the printing paper 3 about the winding shaft 33 (rewind core 34) is started. In this state, the operator continuously pushes the start-stop button 36, and as long as the signal thereof is outputted, the winding shaft 33 is rotationally driven by the drive unit (drive motor 32) at a speed lower than the usual winding speed, and the winding of the printing paper 3 by the winding shaft 33 is temporarily stopped and the initial set state is assumed when the tension roller 13 reaches the fourth tension region R4 (more accurately, at the point in time the tension roller reached the boundary section of the third tension region R3 and the fourth tension region R4).

The usual winding speed in the printing paper winding device 2 is set higher than the carry-out speed in the process of printing and discharging the printing paper 3 with the printer 1.

Furthermore, at the time at which a transition is made from the first tension region R1 to the second tension region R2 and then to the third tension region R3, the winding speed can be raised so that the start operation and winding operation can be executed at a high speed.

Depending on the initial set operation of the operator, the tension roller 13 can be in a tension region other than the first tension region R1. But in this case, too, the winding control unit 18 determines the tension region for the tension roller 13, in the same manner as described above, rotationally drives the winding shaft 33 at a speed lower than the usual winding speed as long as the signal from the start-stop button 36 is outputted, and temporarily stops the winding of the printing paper 3 with the winding shaft 33 to obtain the initial set state when the tension roller 13 reaches the fourth tension region R4.

When the initial set state has been completed, with the tension roller 13 set in the fourth tension region R4, the printer 1 is started in this state. If the printing paper 3 is printed upon and discharged, the tension roller 13 descends from the fourth tension region R4 via the third tension region R3 along the arcuate guide groove 22 in the direction of the second tension region R2 and the first tension region R1, while maintaining its contact under the predetermined tension with the printing paper 3 in the winding path 21.

When the tension roller 13 descends to the first tension region R1 (more accurately, when it reaches the boundary section between the second tension region R2 and the first tension region R1), the winding of the printing paper 3 with the winding shaft 33 is restarted, and the tension roller 13 rises along the arcuate guide groove 22, and following this winding operation, moves through the second tension region R2 and the third tension region R3, and reaches again the fourth tension region R4, and there stops the winding. In this stopped state, the system waits for subsequent printing and discharging of the printing paper 3 by the printer 1 and, as soon as the printing paper 3 is discharged, winding is restarted, as described above, at the time when the tension roller 13 reaches the first tension region R1.

The winding operation can be ended by pushing the start-stop button 36 in the control unit 16.

In the usual winding operation, it can be ensured that the first tension region R1 and the fourth tension region R4 are margin regions by operating the control so that the tension roller 13 reciprocates within the second tension region R2 and the third tension region R3.

In this way, the operator can conduct the winding operation of the initial setting of the printing paper 3 at a rate slower than the usual winding rate by merely continuously pushing the start-stop button 36 in the control unit 16. Therefore, at the time of initially setting control of the printing paper 3, the rotation of the printing paper 3 can be started at will and the winding operation can be conducted safely and reliably.

The present invention is especially advantageous when a printing paper 3 with a low resistance to bending stresses is wound. In contrast with the above-described usual winding operation, the winding unit 15 or its drive motor 32 can be controlled so as to limit the tension region of the tension roller 13 to the predetermined range.

The explanation will be provided below by using an RFID label continuous body as an example of printing paper with a low resistance to bending stresses.

Figure 6:
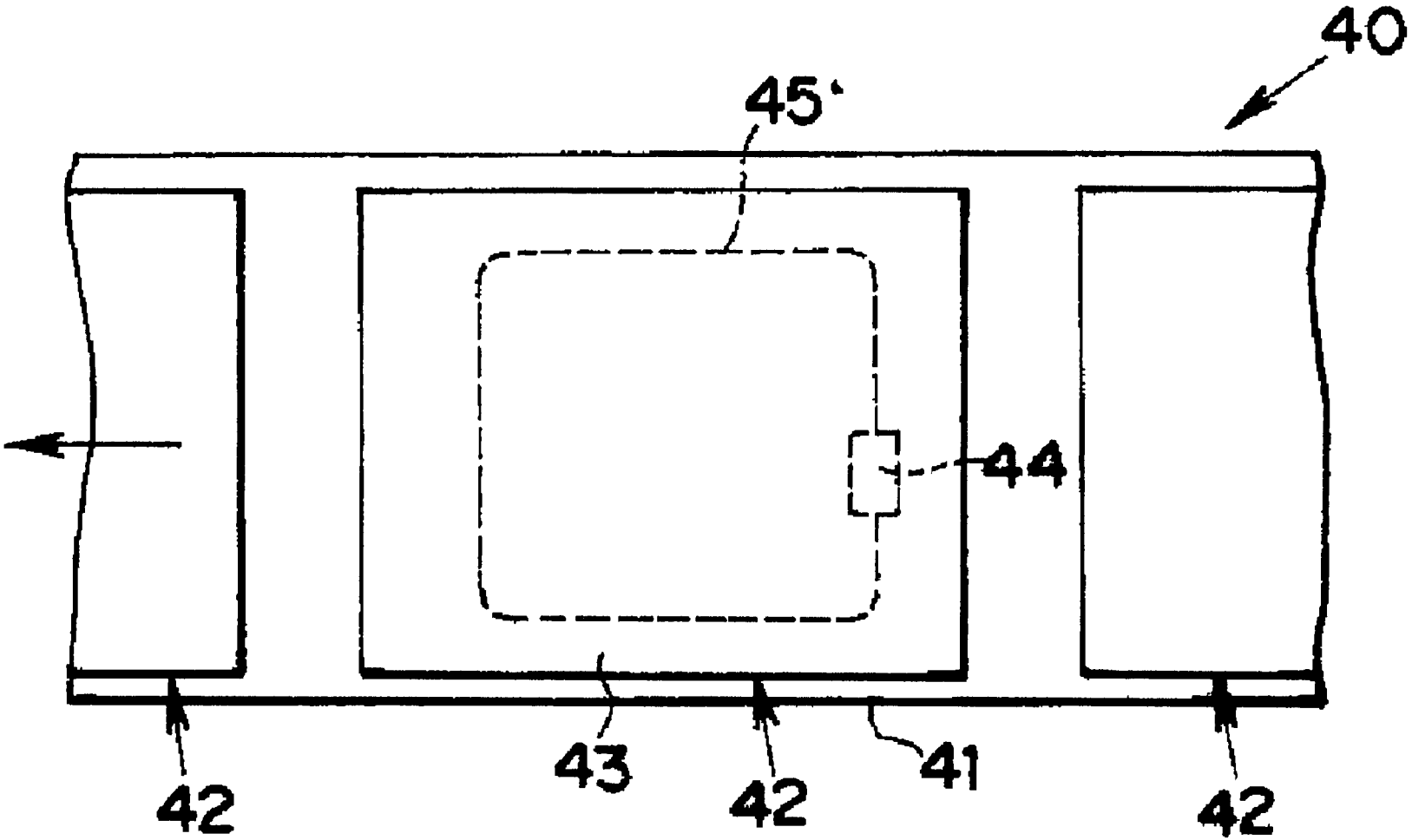
FIG. 6 is a plan view showing an RFID label continuous body 40 (printing paper)

FIG. 6 is a plan view illustrating an RFID label continuous body 40 (printing paper). The RFID label continuous body 40 has a band-like base paper 41 and a plurality of RFID labels 42 removably attached to the base paper 41.

The RFID label 42 (Radio Frequency Identification label) has a label body 43, an IC chip 44 incorporated into the label body 43, and an antenna 45.

The IC chip 44 can read and write data remotely with an external data read/write device (not shown in the figure) via an antenna 45, and data can be electronically written into the IC chip 44 and read therefrom.

The portions of the RFID label continuous body 40 where the RFID labels 42 are located have especially low resistance to bending stresses.

Figure 7:
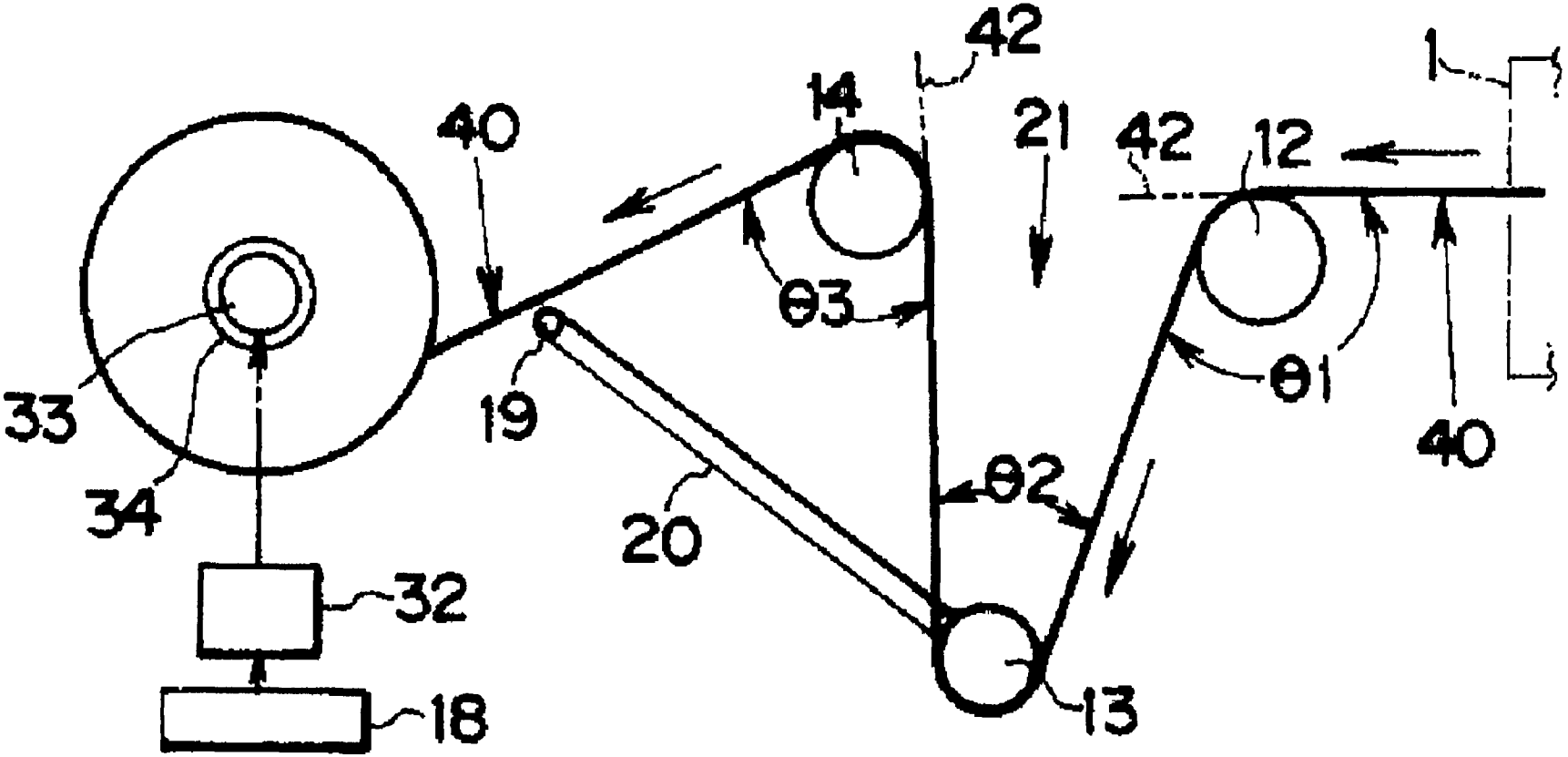
FIG. 7 is an enlarged side view of the tension roller and winding unit portion illustrating a state in which the tension roller is positioned in the first tension region.

FIG. 7 is a main enlarged side view of the tension roller 13 and the winding unit 15 portion. This figure illustrates a state in which the tension roller 13 is positioned in the first tension region R1.

As shown in FIG. 7, when the tension roller 13 is positioned in the first tension region R1, the bending angles of the winding path 21 of the RFID label continuous body 40 become minimized or more acute. More specifically, the first bending angle θ1, second bending angle θ2, and third bending angle θ3 become minimized, so that when the tension roller is positioned in the first tension region R1, the bending stresses become maximized.

The first bending angle θ1 is the bending angle of the winding path 21 of the RFID label continuous body 40 formed by the printer 1, the first fixed guide roller 12, and tension roller 13.

The second bending angle θ2 is the bending angle of the winding path 21 of the RFID label continuous body 40 formed by the first fixed guide roller 12, tension roller 13, and second fixed guide roller 14.

The third bending angle θ3 is the bending angle of the winding path 21 of the RFID label continuous body 40 formed by the tension roller 13, second fixed guide roller 14, and winding shaft 33.

In particular, in the location of the tension roller 13 in FIG. 7, the second bending angle θ2 formed by the printing paper 3 becomes more obtuse and the effect of bending stresses on the RFID label continuous body 40 is minimized.

Figure 8:
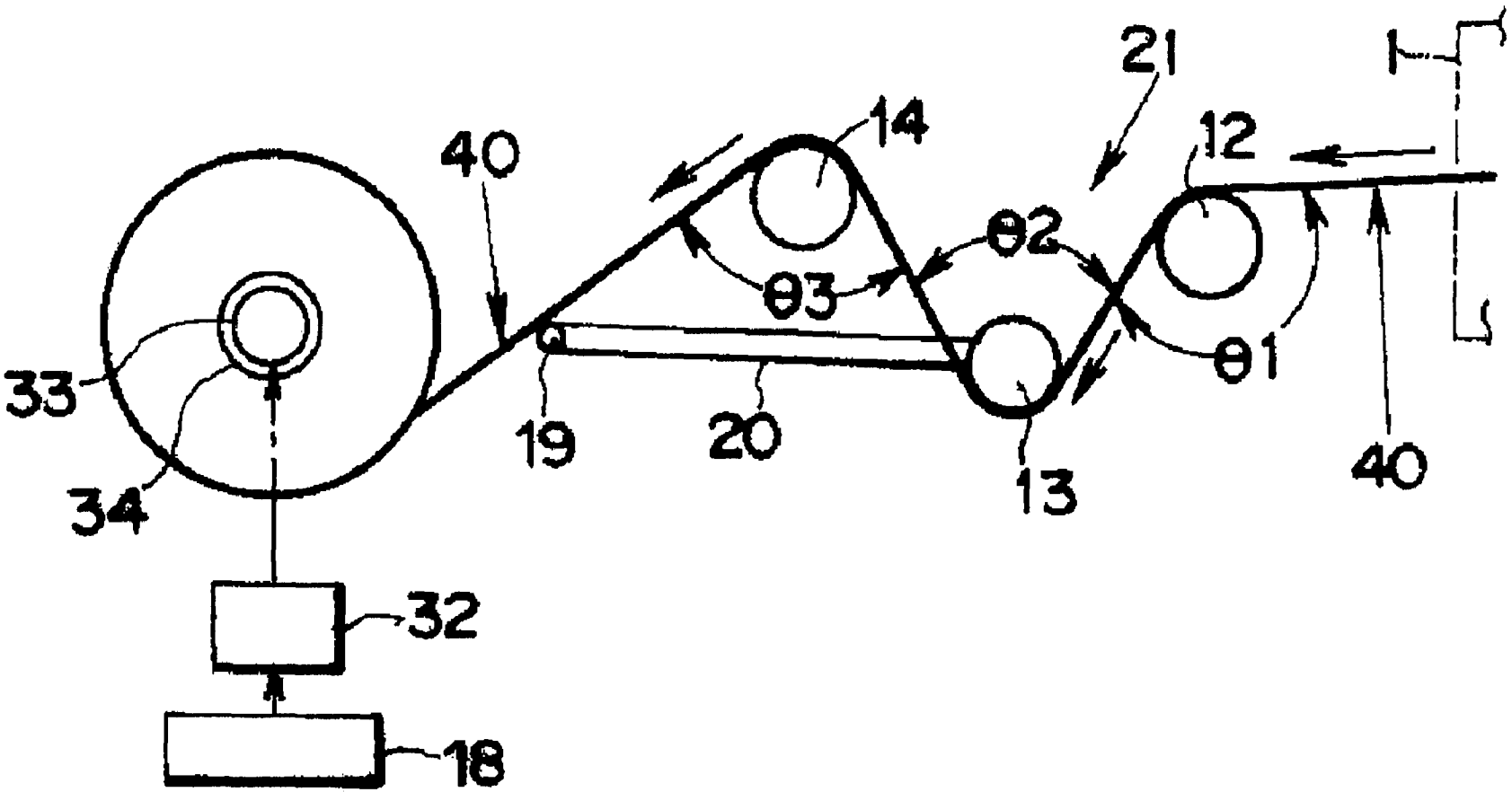
FIG. 8 is an enlarged side view of the tension roller and winding unit portion illustrating a state in which the tension roller is positioned in the fourth tension region.

FIG. 8 is a main enlarged side view of the tension roller 13 and the winding unit 15 portion, which is similar to that shown in FIG. 7. This figure illustrates a state in which the tension roller 13 is positioned in the fourth tension region R4.

In the state shown in FIG. 8, the first bending angle θ1, second bending angle θ2, and third bending angle θ3 become maximized or more obtuse, so that when the tension roller is positioned in the fourth tension region R4, the bending stresses become minimized.

In accordance with the present invention, the control is operated so that the first bending angle θ1, second bending angle θ2, and third bending angle θ3 become closer to more obtuse angles, or so that the tension region where the tension roller 13 is positioned becomes closer to the fourth tension region R4.

More specifically, a dip switch 46 (FIG. 1, FIG. 2) is provided in the device body 11, and the tension region in which the tension roller 13 is to be positioned can be selected with the dip switch 46.

When the usual printing paper 3 is wound up, the winding control unit 18 controls the drive motor 32 so that the tension roller 13 reciprocates within the second tension region R2 and the third tension region R3 (more accurately, between the boundary between the first tension region R1 and the second tension region R2 and the boundary between the third tension region R3 and the fourth tension region R4). But in the case of an RFID label continuous body 40, the drive motor 32 is ON/OFF controlled so that the tension roller 13 reciprocates from the second tension region R2 to the fourth tension region R4 (more accurately, the uppermost portion or upper dead center of the fourth tension region R4) or from the third tension region R3 to the fourth tension region R4 (more accurately, the uppermost portion or upper dead center of the fourth tension region R4).

For example, when the tension roller 13 is reciprocated between the third tension region R3 and the fourth tension region R4, the winding control unit 18 turns on the drive motor 32 and starts the winding operation of the RFID label continuous body 40 when the tension roller 13 reaches the third tension region R3 (more accurately, the boundary between the second tension region R2 and the third tension region R3). When the upper dead center of the fourth tension region R4 is reached, the drive motor 32 is turned OFF and a state of waiting for the supply of the RFID label continuous body 40 from the printer 1 is assumed.

The drive motor 32 is controlled so as to limit the tension roller 13 to a tension region that enables winding in the direction such that the bending angle of the winding path 21, which follows the winding of the RFID label continuous body 40, is close to a more obtuse angle. In this case, the RFID label continuous body 40 undergoes bending in the sections of the first fixed guide roller 12, tension roller 13, and second fixed guide roller 14, wherein the RFID label 42 or the like can be prevented from being fractured or inadvertently disconnected by the above described control.

Furthermore, at a small or acute bending angle such as shown in FIG. 7, in particular in the section of the first fixed guide roller 12 and the second fixed guider roller 14, the RFID label 42 may not follow the turning of the base paper 41 and may instead peel off from the base paper 41 (see virtual line in the figure). Such a peeling off of the RFID label 42 can be also avoided by increasing the bending angle so as to make it close to an obtuse angle, as shown in FIG. 8.

Figure 9:
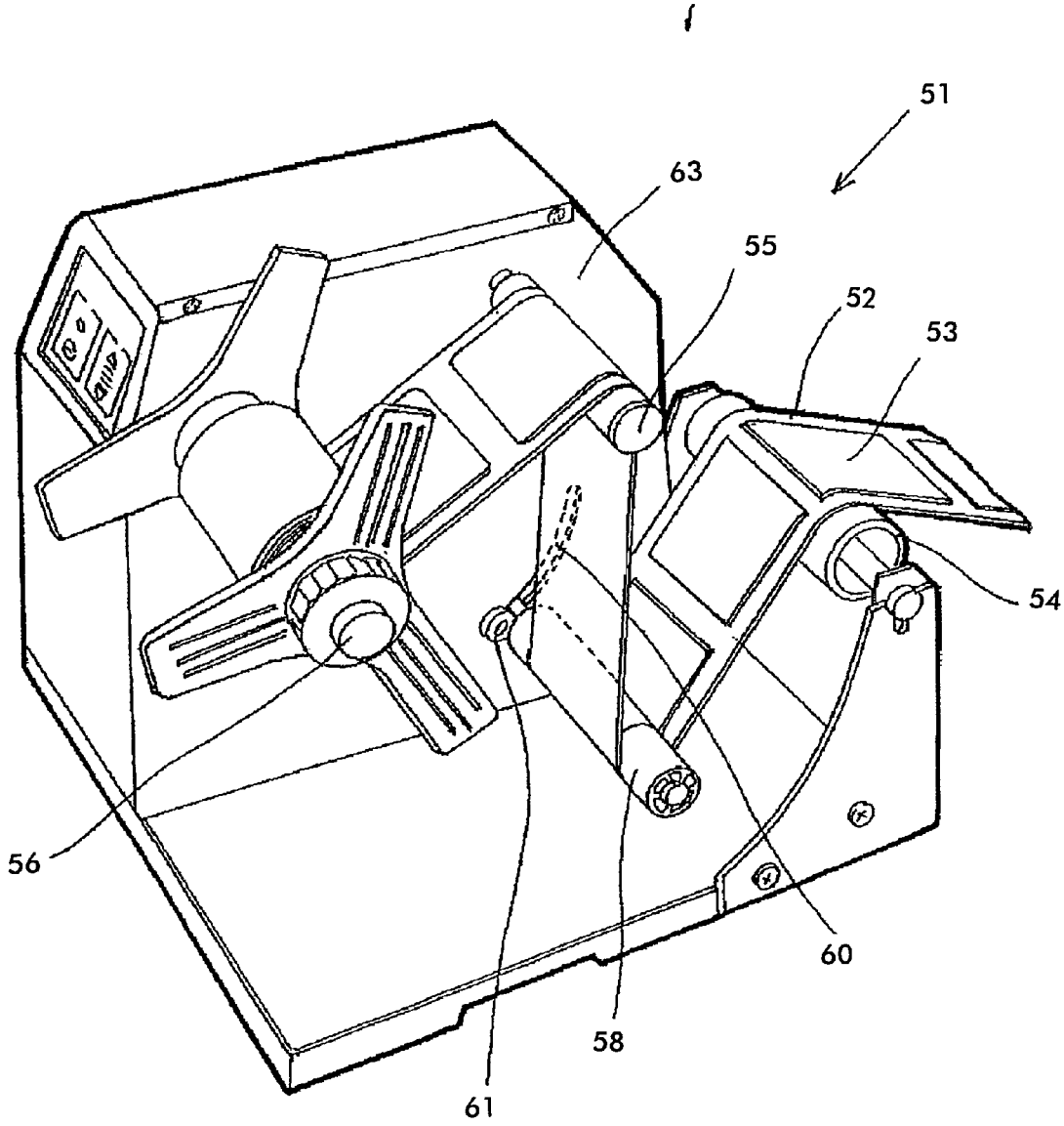
FIG. 9 is a perspective view as in FIG. 2 of a modified embodiment of the printing paper winding device.
Figure 10:
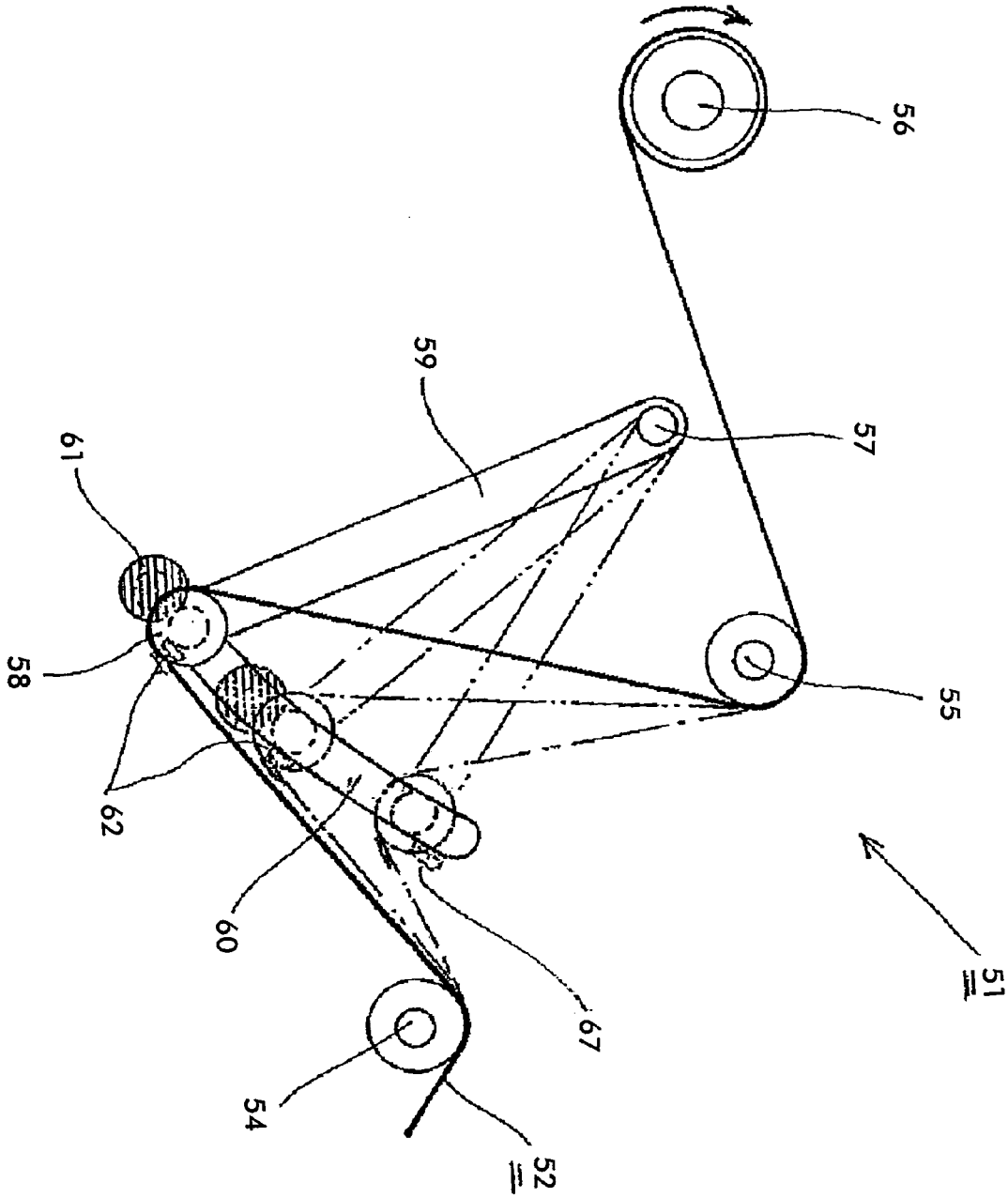
FIG. 10 schematically illustrates operation of the modified embodiment.

A web-winding apparatus 51 of this modified embodiment of FIGS. 9 and 10 comprises a first guide roller 54 and second guide-roller 55 for a continuous web 52 which can be guided along its winding path. A tension roll 58 provided on the end of a swingable tension arm 59 contacts the continuous web 52 from above and is spaced between first guide roller 54 and second guide-roller 55. A winding spindle 56 receives and winds up the continuous web 52. A guide in the form of circular arcuate slit 50 is formed vertically on the lateral surface 63 of the housing, along the swinging movement of the tension roll 58.

In this embodiment, a restricting member (a catching member) 61 is provided for selectively controlling swinging movement of the tension roll 58 over a movement range. A detecting member 62 detects the lowest position of the tension roll 58 to travel in a movement range. The detecting member 67 detects the position of the tension roll in the upper part of the tension roll 58 movement range.

The lowest part is the most inferior point in the movable range in which the tension roll can travel.

The tension roll 58 is provided on the one end of a tension arm 59. The other end of the tension arm 59 is swingably connected by an arm axis 57, and which is provided on inner side of the lateral surface 63 on the housing.

The tension roll 58 can be received and supported in a circular arcuate guide in the form of a slit 60 formed vertically on the lateral surface 63 of the housing. The roll 58 extends across the winding path of the continuous web 52.

Also, the tension roll 58 can be pulled downward in the circular arcuate slit 60 by a tensioning force. The tensioning force urges the tension roll 58 into contact with the continuous web 52 from upwardly in the circular arcuate slit 60 by means of a tension spring or by the weight of the tension roll 58 itself.

FIG. 10 shows the tension roll 58 in full line illustrating the lowest position in the movement range where the tension roll 58 contacts the restricting member 61, as in full line, and the tension roll 58 is shown in chain line illustrating a another lowest position in the movement range of the tension roll 58 to be shifted which is caused by contact of the tension roll 58 in the restricting member 61 and is shown in a chained line.

The restricting member 61 restricts the travel of the tension arm 59 and can hold the tension roll 58 in a selected position within the circular arcuate slit 60, allowing the tension roll 58 to travel over an arcuate movement range that can be selected. Therefore, the moveable tension roll 58 may be spaced between first guide roller 54 and second guide-roller 55, and an angle in the winding path of continuous web 52 can be easily changeable with an end limit on the tension roll 58 travel. The tension roll 58 can be held in an upper position within the circular arcuate slit 10 to limit and select an angle in the winding path of the continuous web 52.

The restricting member 61 is a hard, but somewhat elastic, member with an H-form in cross section (not shown). It has spaced apart end sections across the width direction of the circular arcuate slit 60 that engage the sides of the wall of the housing at the slit and therefore which allow easy manual shifting and positioning of the member 61 along the length of the slit.

Also, a detecting member or sensor for the lowest part 62 is movably provided on the restricting member 61 to move with it. It can detect the lowest part of the path of the tension roll 58 to be traveled in the movement range of the tension roll 58.

Furthermore, a detecting member 67 can detect the upper part of the movement range of the tension roll 58.

The tension roll 58 absorbs a rate differential provided between the feeding speed of the continuous web 52 and the winding speed of the winding apparatus 51 by depending on the swinging movement of the tension roll 58.

The detecting member 67 detects when the tension roll 58 is in the upper part of the circular arcuate slit 60. At that time, the driven part for driving the take up spindle 56, for example the winding motor, is disabled. The tensioning force can be controlled for the continuous web 52 allowing continuous web feeding from the printer.

The tension roll 58 moves downward in accordance with the discharge of the continuous web 52 from the printer. When the tension roll 58 reaches the lowest part of the circular arcuate slit 60, the micro-switch 62 can be turned on, to drive the winding motor to start the continuous web 52 winding.

A continuous web 52 provided on the winding apparatus according to this invention may have various-shapes, RFID-Tag or label, or roll-shaped-Tag or label, an RFID-Tag or label having an RFID inlay, an RFID inlay including a single IC comprising an IC chip 66 and a coil antenna part 65 with coil shaped provided in the middle layer of the RFID-Tag or Label. These are sensitive to bending stress. A reasonable bend angle can be set for the web of labels or tags, raising the position of lowest part of the movement path by arranging the restricting member 11 to restrict the movement of the tension roll 8, which can provide a control for available winding thereof without a considerable acute angle.

Further, a continuous web 52 (i.e., a continuous label web) having a soft adhesive agent to apply the label strip on the continuous base 64 may be provided. The swinging movement of the tension roll 58 makes an angle in the winding path, and allows the tension roll 58 to even optionally function as a peel bar. In that case, the continuous base 64 is dragged in the reverse direction which peels the labels of the label strip 53 off the continuous base 64, since the stiffness of the elastic body of the label strip 53 is relatively increased in excess of the adhesion strength. However since the restricting member 61 can be optionally placed within the circular arcuate slit 60, preferable rewinding can be made.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A printing paper winding device comprising:

a winding shaft for winding on a band-like printing paper received from a printer;

a drive unit for rotationally driving the winding shaft;

a tension roller that contacts the printing paper upstream of the winding shaft and is operable to apply tension to the printing paper by reciprocation of the tension roller through a prescribed tension region, following the winding of the printing paper;

the printing paper winding device further comprising:

a first sensor and a second sensor operable for detecting the portion of the prescribed tension region in which the tension roller is positioned; and a winding control unit operable for determining, based on output signals of the first sensor and second sensor, whether a part of the prescribed tension region in which the tension roller is then positioned is a first tension region in which the bending angle of the winding path of the printing paper becomes minimized, a second tension region, a third tension region, or a fourth tension region in which the bending angle of the winding path of the printing paper becomes maximized, wherein the tension regions are arranged continuously from the first to the fourth tension region, with successive regions adjacent to each other; and the winding control unit is operable to control the drive unit to limit the tension roller to the tension region in which winding can be conducted in the direction such that the bending angle of the winding path that follows the winding of the printing paper is close to a more obtuse angle than to a more acute angle.

2. The printing paper winding device according to claim 1, wherein the winding control unit is operable to control the prescribed tension region where the tension roller is positioned so that the tension region in which the tension roller is located becomes closer to the fourth tension region.

3. In combination, a printer operable for printing a band-like printing paper and the winding device of claim 2 to receive the paper from the printer.

4. The printing paper winding device according to claim 3, further comprising a control unit operable for controlling the printer for printing on the printing paper; and wherein the winding control unit controls the printing paper winding device independently from the printer control unit of the printer for printing on the printing paper.

5. The printing paper winding device according to claim 1, further comprising a dip switch operable to select the tension region at which the tension roller is positioned, wherein the winding control unit is operable to control the tension region at which the tension roller is positioned according to setting conditions that are set with the dip switch.

6. The printing paper winding device according to claim 1, further comprising:

a first fixed guide roller positioned upstream of the tension roller in the path of the printing paper and operable for guiding and introducing the printing paper from the printer into the printing paper winding device, and a second fixed guide roller after the first guide roller in the path of the printing paper for guiding the printing paper from the tension roller onto the winding shaft, and the control is conducted so that the bending angle of the winding path of the printing paper formed by the printer, the first fixed guide roller, and the tension roller is made closer to a more obtuse angle than to a more acute angle, the bending angle of the winding path of the printing paper formed by the first fixed guide roller, the tension roller, and the second fixed guide roller is made closer to a more obtuse angle than to a more acute angle, and the bending angle of the winding path of the printing paper formed by the tension roller, the second fixed guide roller, and the winding shaft is made closer to a more obtuse angle than to an acute angle.

7. The printing paper winding device according to claim 1, wherein the printing paper has a label which includes an IC chip in which data can be read and written remotely.

8. The printing paper winding device according to claim 1, further comprising:

a roller arm for holding the tension roller;

a roller rotary shaft that rotatably supports the roller arm so that the roller arm is operable to move the tension roller reciprocally in the forward and backward direction generally along the winding path; and a sensor plate that rotates about the roller rotary shaft and has spaced apart sensed elements that are detectable by the first sensor and the second sensor.

9. The printing paper winding device according to claim 8, wherein the spaced apart sensed elements are alternately formed in the sensor plate as detection protrusions and detection recesses.

10. The printing paper winding device according to claim 8, wherein the roller arm is supported at an axis to pivot so as to cause the tension roller to swing in its reciprocating motion.

11. The printing paper winding device according to claim 10, further comprising a restriction in the pathway of swinging of the tension roller positionable to restrict the movement of the tension roller toward the first tension region.

12. The printing paper winding device according to claim 11, wherein the position of the restriction along the path of swinging is adjustable.

13. A printing paper winding device comprising:

a winding shaft for winding on a band-like printing paper received from a printer along a path of the printing paper;

a drive unit for rotationally driving the winding shaft;

a tension roller that contacts the printing paper upstream of the winding shaft and is operable to apply tension to the printing paper by reciprocation of the tension roller through a prescribed tension region, following the winding of the printing paper;

a tension arm for holding the tension roller;

a control unit for controlling movement of the tension roller;

a roller rotary shaft that rotatably supports the tension arm so that the roller arm is operable to move the tension roller reciprocally in the forward and backward direction generally along the winding path;

wherein movement of the tension roller in one direction decreases the bend angle of the printing paper at the tension region and movement in an opposite second direction increases the bend angle;

a first fixed guide roller positioned upstream of the tension roller in the path of the printing paper and operable for guiding and introducing the printing paver from the printer into the printing paper winding device, and a second fixed guide roller after the first guide roller in the path of the printing paper for guiding the printing paper from the tension roller onto the winding shaft, and the control unit is operable such that the bending angle of the winding path of the printing paper formed by the printer, the first fixed guide roller, and the tension roller is made closer to a more obtuse angle than to a more acute angle, the bending angle of the winding path of the printing paper formed by the first fixed guide roller, the tension roller, and the second fixed guide roller is made closer to a more obtuse angle than to a more acute angle, and the bending angle of the winding path of the printing paper formed by the tension roller, the second fixed guide roller, and the winding shaft is made closer to a more obtuse angle than to an acute angle.

14. The printing paper winding device according to claim 13, wherein the roller arm is supported at an axis to pivot so as to cause the tension roller to swing in its reciprocating motion.

15. The printing paper winding device according to claim 14, further comprising a restriction in the pathway of swinging of the tension roller positionable to restrict the movement of the tension roller toward the first tension region.

* * * * *